US005655366A

United States Patent [19]

Kawamura

[11] Patent Number: 5,655,366

[45] Date of Patent: Aug. 12, 1997

[54] DIESEL PARTICULATE FILTER

[75] Inventor: Hideo Kawamura, Samukawa, Japan

[73] Assignee: Isuzu Ceramics Research Institute Co. Ltd., Kanagawa, Japan

[21] Appl. No.: 443,026

[22] Filed: May 17, 1995

[30] Foreign Application Priority Data

May 17, 1994 [JP] Japan ..... 6-126830
May 17, 1994 [JP] Japan ..... 6-126831

[51] Int. Cl.[6] ..... F01N 3/02

[52] U.S. Cl. ..... 60/286; 60/288; 60/311; 55/487; 55/523; 55/DIG. 30

[58] Field of Search ..... 60/311, 286, 288; 55/267, 487, 523, 312, DIG. 30

[56] References Cited

U.S. PATENT DOCUMENTS

| | | | |
|---|---|---|---|
| 4,264,344 | 4/1981 | Ludecke et al. . | |
| 4,346,557 | 8/1982 | Shadman et al. . | |
| 4,390,355 | 6/1983 | Hammond, Jr. et al. | 55/DIG. 30 |
| 4,600,562 | 7/1986 | Virk et al. | 55/487 |
| 4,704,863 | 11/1987 | Abthoff et al. | 55/487 |
| 4,829,766 | 5/1989 | Henkel | 60/311 |
| 5,171,341 | 12/1992 | Merry | 55/DIG. 30 |
| 5,212,948 | 5/1993 | Gillingham et al. | 55/523 |
| 5,238,472 | 8/1993 | Pfister et al. | 55/523 |
| 5,238,478 | 8/1993 | Zievers et al. | 55/523 |
| 5,269,921 | 12/1993 | Ruger et al. | 55/487 |
| 5,454,845 | 10/1995 | Anahara et al. | 55/487 |
| 5,486,220 | 1/1996 | Honda et al. | 55/487 |

FOREIGN PATENT DOCUMENTS

| | | | |
|---|---|---|---|
| 2-600 907 | 8/1988 | France . | |
| 2705942 | 8/1977 | Germany | 55/487 |
| 3-341 177 | 5/1984 | Germany . | |
| 2-007 532 | 5/1979 | United Kingdom . | |

*Primary Examiner*—Douglas Hart
*Attorney, Agent, or Firm*—Staas & Halsey

[57] ABSTRACT

There is disclosed a diesel particulate filter for filtering exhaust gasses of a diesel engine while collecting particulates and burning them by electric heat. The diesel particulate filter includes at least one filter body disposed in a filter case with filtering passages characterized as coarseness or mesh which gradually changes density of the exhaust flow as it moves from an upstream side toward a downstream side.

10 Claims, 2 Drawing Sheets

DIESEL PARTICULATE FILTER

DETAILED DESCRIPTION OF THE INVENTION

1. Field of the Invention

The present invention relates to a diesel particulate filter for collecting and burning particulates contained in exhaust of a diesel engine.

2. Description of the Related Art

Since the diesel engine employs a heterogeneous combustion in which fuel is injected into air which is elevated in temperature by heat insulating compression to effect combustion, there exists a problem that less carbon monoxide is contained in exhaust but a large amount of nitrogen oxide (NOx) and particulates (mainly, carbon) are contained therein.

As means for coping with the aforementioned point, a method of using a high pressure pump as a fuel pump to reduce particulates themselves and a method of mounting a filter in an exhaust flowpassage to filter particulates in the exhaust have been studied and developed. The former method uses a special pump, and the engine itself is extremely expensive. Therefore, an effective filtration method, capable of achieving purification of exhaust at a lower cost, has been hoped for. Attention has been paid to a ceramic material for a filter body, in which it is formed to be a porous or coarse surface to thereby provide a large particulate adsorption ability.

In the conventional particulate filter of this kind, particulates have been filtrated by a single kind of a filter. The exhaust is introduced into an exhaust pipe as an exhaust valve is opened but flow velocity and pressure of exhaust always varies with the number of revolutions of the engine and load. It is required that the exhaust pipe releases the exhaust at low resistance. On the other hand, the particulates contained in the exhaust of the diesel engine are extremely fine within the combustion chamber of the engine but as the particulates flow into the exhaust pipe via the exhaust valve, fine particles are gradually gathered and grow together as large particles. It is said that the distribution of particle sizes is substantially a normal distribution, and the distribution state of particles is in the range from 2 to 10 μm with 15 μ of the particle diameter being the central value. When such particulates pass through a porous filter, they collide with each other in the vicinity of the inlet of the filter, the particle size further grows, and then the particles are collected. However, the particulates having a particle size in the range of 2 to 100 μm are contained in the exhaust which has reached the filter.

The conventional filter of an single material, which is fine in mesh, has been employed so that particulates of a small particle size can be collected. For this reason, the filter becomes severely clogged such that a portion in the vicinity of the outlet of the filter body is first clogged with particulates and a portion in the vicinity of the inlet is then clogged to increase a gas flow resistance of the filter and to elevate a pressure, impairing a smooth release of exhaust.

SUMMARY OF THE INVENTION

An object of the invention is to cope with the aforementioned point. A further object of the present invention is to provide an arrangement wherein internal pressure of the filter is made as even as possible to secure a smooth flow of exhaust, a collecting efficiency of particulates is enhanced by making the flow velocity even, a rapid rise of pressure due to the collection of particulates is avoided, and an exhaust pressure of the engine is prevented from being elevated by the filter.

Exhaust, released from the engine, is introduced into the filter at a relatively high speed, and the flow velocity of exhaust is converted into pressure in accordance with the Bernoulli's theorem, due to the fluid resistance of the filter, to increase the pressure of the exhaust. Since the exhaust flows at the inlet portion of the filter, a decrease in flow velocity and an increase in exhaust pressure at the inlet portion are small. The exhaust flows forward deeply within the filter. Since the flow velocity at the upstream side of an exhaust flow is high and a pressure difference before and behind the filter is small, the particulates move forward within the filter, and only the particulates having a large particle size are preferentially collected by the filter. In this manner, the exhaust passes through the filter and moves downstream.

It is to be noted that granular particulates are electrified and caught when they flow in a zigzag manner between fibers interior of the filter and tend to be gradually accumulated. However, if a filtering passage between the fibers is wide, many of the particulates flow out without contacting the fibers, and if the flow velocity of exhaust is high, the particulates are less possibly accumulated. Since the exhaust flow between the fibers having a small diameter at the downstream side of the exhaust flow within the filter, the exhaust is dispersed and the flow velocity of the exhaust decreases so that it often contacts the fibers. Since the coarseness or mesh of the filter in the downstream portion is fine, a possibility of collecting and accumulating particulates increases, and most of particulates having a small particle size are collected at this time.

That is, in the particulate filter according to the present invention, a guide is provided in order to realize the aforementioned action under the even conditions in the whole area of the filter. The flow rate of exhaust is made even in the whole surface of the filter by the guide, and in addition, the flow velocity of the exhaust is gradually lowered to elevate the pressure evenly as the exhaust flows downstream. Thereby, the particulates in the exhaust can be effectively collected, and even with respect to the pulsation of exhaust in the exhaust pipe, it is possible to reduce a fluctuation of pressure in the filter. When a diameter of the conical guide provided at the inlet of the filter in order to guide the exhaust into the filter is modified, a flow of exhaust becomes more smooth.

In the particulate filter according to the present invention, a plurality of filters, such as a coarse mesh filter, a medium mesh filter, and a dense or fine mesh filter are serially arranged in a direction of flow of the exhaust. Accordingly, it becomes possible to collect particulate matter of all particle diameters without clogging of filter for a short period of time. Further, since the filter having a coarse mesh is located at the most upstream side, it is possible not to increase the pressure of exhaust even if the particulates having a large particle size are collected. Further, since a coarse mesh filter is formed in a cylinder of a small diameter and a fine or dense mesh filter is formed in a cylinder of a large diameter, the dense mesh filter, where a flow resistance per area of exhaust is high and a flow velocity of exhaust is low, will be a large area. Therefore, there is no place where exhaust pressure is locally high. Thus, a flow of exhaust, without rapid rise in pressure due to the collection, is smooth, rendering effective filtering possible.

DETAILED DESCRIPTION OF THE PREFERRED EMBODIMENTS

Figure 1:
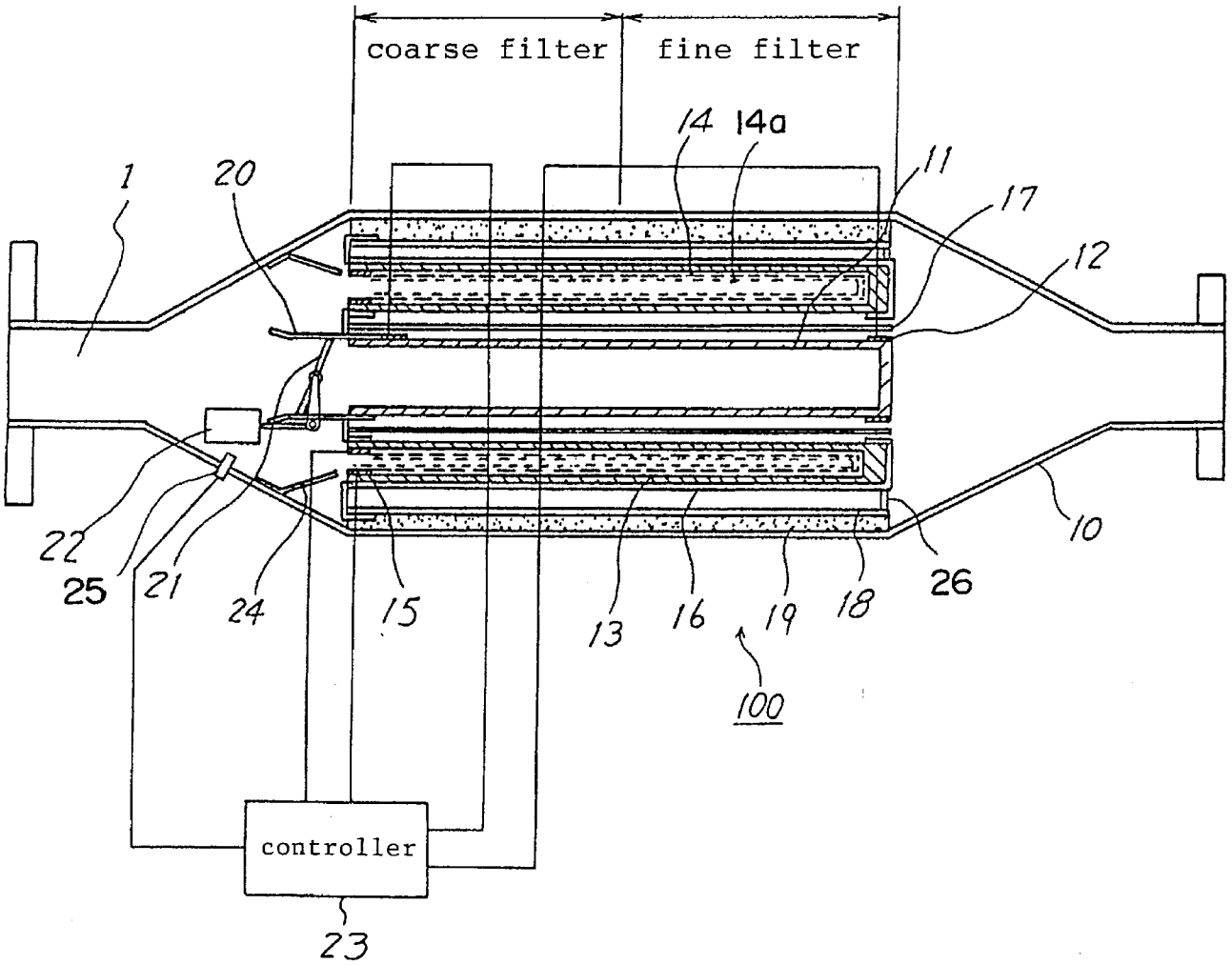
FIG. 1 is a sectional view showing the construction of a particulate filter according to a first embodiment of the present invention.

FIG. 1 is a sectional view showing the particulate filter according a first embodiment of the present invention. As shown in FIG. 1, in a particulate filter 100 by the present embodiment, a closed-end cylindrical bypass pipe 11 having substantially the same diameter as that of an exhaust pipe 1 is installed in coaxial relationship within a central portion of the cylindrical steel filter case 10. The bypass pipe 11 is formed of porous silicon carbide (SiC) ceramic or porous metal, the bypass pipe itself having a filter function. The bypass pipe 11 has an electric conductivity, and electric power is supplied through an electrode 12 to burn the collected particulates.

A fiber filter 13 (a filter body) formed of ceramic fibers is arranged in the outer periphery of the bypass pipe 11. The fiber filter 13 comprises inner and outer tubes which are coaxially disposed and connected to each other at the right end. The fiber filter 13 constitutes a coarse filter at the left portion, that is, at the inlet side of the filter, and constitutes a dense filter at the right portion, that is, at the closed end portion. The left portion of the fiber filter 13 is formed of bold or thick ceramic fibers (diameter 10 to 20 μm) having a coarse surface, and the right portion thereof is formed of fine or thin ceramic fibers (diameter 10 to 15 μm) having a dense surface. The process of making the surface of the ceramic fibers coarse is accomplished by a reheating process after the step of forming ceramic fibers by way of sintering. Alternatively, the fiber filter 13 may be formed such that the coarsness or mesh of the filter gradually reduces from the inlet portion to the closed end portion.

A metal wire-net heater 14 for burning the collected particulates is provided on the upstream side surface or inner surface for receiving the exhaust of the fiber filter 13, the metal wire-net heater 14 being formed at an end thereof with an electrode 15. The metal wire-net heater 14 is formed from a resistance wire, for example, such as a nickel-chrome alloy and a ceramic material is coated on the surface of the metal wire-net heater 14. The fiber filter 13 and the metal wire-net heater 14 are held by a porous ceramic tube 16.

The metal wire-net heater 14 is internally provided with a metal guide tube **14*a*. The metal guide tube 14*a* is disposed so as to cover the outer surface of the metal wire-net heater 14. The metal guide tube 14*a* is provided with a suitable number of holes through which exhaust passes. It is constructed so that when the exhaust flows through the fiber filter 13, the flow velocity is converted into pressure, and when the exhaust flows into the fiber filter 13, the metal guide tube 14*a*** causes the exhaust not to generate large pulsations.

Between the bypass pipe 11 and the fiber filter 13 is a rectifying pipe 17 for preventing exhaust discharged from one side from being blown to the other side and exhaust heat from being radiated. A cylindrical exhaust guide pipe 19 is arranged outside the porous ceramic tube 16, and between the exhaust guide pipe 18 and the filter case 10 is arranged a heat insulating member 19 for thermally separating between them. Support 26 separates ceramic tube 16 from exhaust pipe 18.

A trumpet-like guide pipe 20 is mounted at the inlet of the bypass pipe 11, and the guide pipe 20 is interiorly provided with a bypass valve 21 for controlling a flow of exhaust to the bypass pipe 11. The bypass valve 21 is opened and closed by an actuator 22 controlled by a controller 23. A convergent conical guide plate 24 for arranging exhaust is mounted at the inlet of the fiber filter 13. In normal operation, the bypass valve 21 is closed, and accordingly, the exhaust does not pass through the bypass pipe 11. At this time, the exhaust coming from the left side is guided by the conical guide 24 and introduced into the fiber filter 13. The exhaust gradually lowers its flow velocity while passing through the flowpassage within the double cylindrical fiber filter 13, and is released outside of the fiber filter 13 while slowly filtrating the particulates. In the above-described filtration process, particulates having a large particle size are collected mainly by a coarse filter portion on the inlet portion, and particulates having a small particle size are collected mainly by a dense filter portion on the closed end portion.

In case where the clogging occurs in the filter 13 due to the operation of the engine for a long period of time, the bypass valve 21 is opened by the actuator 22 controlled by the controller 23 to introduce the exhaust into the bypass pipe 11, and the metal wire-net heater 14 on the filter 13 is energized to burn the particulates. At this time, the filtration of exhaust is performed by the porous cylinder of the bypass pipe 11. When passing a predetermined time after starting of energization to the metal wire-net heater 14, the energization to the metal wire-net heater 14 is stopped and the bypass valve 21 is closed, and subsequently, electric power is supplied to the bypass pipe 11 through the electrode 12 of the bypass pipe 11 to reproduce the bypass pipe 11. Here, since a fine clearance is present in the bypass valve 21, air necessary for burning the particulates is introduced into the bypass pipe 11.

While the reproducing operation of the filer 13 can be automatically performed by the controller 23, it is to be noted that it can be manually performed by a driver.

While in the above embodiment, the coarsness or mesh of the fiber filter 13 has been divided into two grades, it is to be noted that the mesh of the fiber filter 13 can be divided into three grades of meshes or more, and further the grade of mesh can be continuously changed. Further, the filter 13, in stead of the ceramic fibers, may comprises porous ceramics. Moreover, while in the aforementioned embodiment, the filter 13 is supported by the porous ceramic tube, it is to be noted that the filter 13 may be supported by a porous metal tube.

Figure 2:
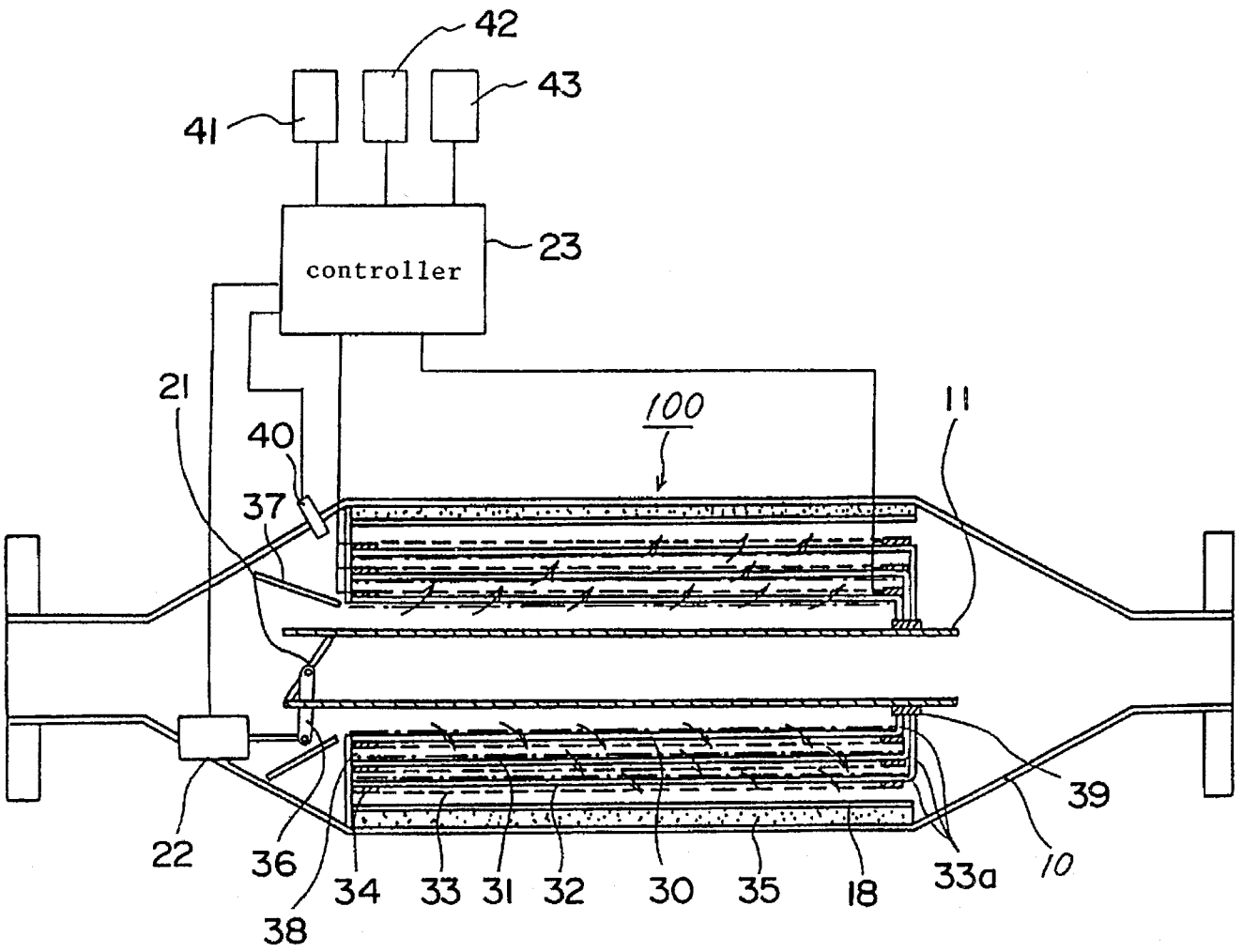
FIG. 2 is a sectional view showing the construction of a particulate filter according to a second embodiment of the present invention.

FIG. 2 is a sectional view of a particulate filter according to second embodiment of the present invention. As shown in FIG. 2, in a particulate filter 100 according to the present embodiment, a cylindrical bypass pipe 11 is arranged in a central portion interior of a filter case 10 made of steel, and closed-end cylindrical filters 30 to 32 are arranged outside the bypass pipe 11.

More specifically, three kinds of filters, i.e. a coarse filter 30, a medium filter 31 and a dense filter 32, are concentrically installed in that order from the inside. This arranging state is called a flowpassage series arrangement. Each of the filters 30 to 32 are formed of woven fabric or non-woven fabric formed of porous ceramic fibers of silicon carbide (SiC). The coarse filter 30, the medium filter 31 and the dense filter 32 comprise non-woven fabrics that coarse ceramic fibers (diameter 20 to 30 μm), medium ceramic fibers (diameter 10 to 20 μm) and fine ceramic fibers (diameter 5 to 10 μm), respectively, are laminated and partly entangled.

Each of the filters 30 to 32 is interposed between a wire-net heater 33 and a mesh-like cylindrical metal support body 33*a*. Annular electrodes 34 are formed on the opposite ends of each of the metal wire-net heaters 33.

In place of the construction in which the filters 30 to 32 and the wire-net heater 33 are supported by the support body 33*a*, the filters 30 to 32 may be held within a cylindrical container made of porous steel or ceramic having a high rigidity.

An exhaust guide pipe 18 is installed externally of the outermost dense filter 32, and an insulating sheet 35 is arranged between the exhaust guide pipe 18 and the filter case 10.

In the vicinity of the inlet of the bypass pipe 11 is provided a bypass valve 21 for controlling a low of exhaust. The bypass valve 21 is opened and closed through an arm 36 by an actuator 22. The operation of the actuator 22 is controlled by a controller 23. The controller 23 receives signals from the exhaust pressure sensor 40, the engine r.p.m. sensor 41, the idling sensor 42, and the engine load sensor 43 and supplies electric power to the metal wire-net heater 33 through electrodes 34 when the particulates are burned. A trumpet-like inlet guide 37 is arranged externally of an inlet portion of the bypass pipe 11.

In normal operation, the bypass valve 21 is closed, and accordingly, the exhaust does not flow into the bypass pipe 11. At this time, exhaust flow from the left side in the figure is guided by the guide 37 and introduced into the flowpassage between the bypass pipe 11 and the coarse filter 30. When the exhaust flows through the coarse filter 30, the medium filter 31 and the dense filter 32 in that order as indicated by the arrows, the exhaust is eliminated gradually of fine particulates and flow out.

In case the operation is continued for a long period of time, clogging occurs in the filters 30 to 32. In the case where the clogging state is detected by an exhaust pressure sensor 40, and the idling state (in which an exhaust flow rate of the engine is small) is detected by the idling sensor 42, the bypass valve 21 is opened by the controller 23, and electric power is supplied to the metal wire-net heater 33 to execute the combustion of particulates. After the passage of a predetermined time, a supply of electric power is stopped and the bypass valve 21 is closed.

It is to be noted that the burning operation for the particulates is automatically performed by the controller 23 in such a way that exhaust pressure is monitored by the controller 23 and judgement is made so that when a predetermined pressure is reached, clogging has occurred. Alternatively, alarm means for indications that clogging has occurred is provided in the driver's seat so that the combustion is manually executed by the driver.

While in the foregoing, a preferable embodiment has been described, it is to be noted that the present invention is not limited to the aforementioned embodiment, but various changes can be made within the scope not changing the gist of the present invention. For example, while in the above embodiment, the filters have been arranged in a three-layer, it is to be noted that the filters 30 to 32 may be arranged in a two-layer or four-layer or more. Further, in place of the construction in which the filters 30 to 32 are formed of woven fabrics or ceramic fibers, they may be formed of woven fabrics of metal fibers or formed of a composite or laminate of woven fabrics of ceramic fiber and woven fabrics of metal fibers.

EFFECT OF THE INVENTION

The diesel particulate filter according to the present invention has the meshes of the filter body to be coarse at the upstream side and to be dense at the downstream side of the exhast flow. Therefore, a flow of exhaust is not greatly decelerated at the inlet surface of the filter, and the flow of exhaust is gradually decelerated over the full length of the filter. In other words, a change in pressure of exhaust is gentle, and the flow of exhaust is smooth.

Therefore, according to the present invention, the provision of the particulate filter permits the engine from being adversely affected and enables the effective filtering of particulates.

In the diesel particulate filter according to the present invention, the coarse-mesh filter at the upstream side of the exhaust flow and the fine-mesh filter at the downstream side of the exhaust flow are arranged in series. Therefore, it is possible to collect effectively all the particulates in the range of large particle size to small particle size while avoiding the occurrence of clogging in a short period of time.

Further, in the case where the coarse-mesh filter is formed to be a cylinder of a small diameter and the fine-mesh filter is formed to be a cylinder of a large diameter, an area of the fine-mesh filter having a high fluid resistance per area is so large or wide that there is no portion where exhaust pressure becomes locally high to enable filtering with a smooth flow of exhaust.

| | |
|---|---|
| 1: | exhaust pipe |
| 10: | filter case |
| 11: | bypass pipe |
| 12: | electrode |
| 13: | fiber filter |
| 14: | wire-net heater |
| 14a: | guide tube |
| 15: | electrode |
| 16: | ceramic tube |
| 17: | recifying tube |
| 18: | guide pipe |
| 19: | heat insulating member |
| 20: | guide pipe |
| 21: | bypass valve |
| 22: | actuator |
| 23: | controller |
| 24: | guide |
| 25: | exhaust pressure sensor |
| 26: | support |
| 30: | course filter |
| 31: | medium filter |
| 32: | dense filter |
| 33: | wire-net heater |
| 33a: | support body |
| 34: | electrode |
| 35: | insulating sheet |
| 36: | arm |
| 37: | guide |
| 38: | clearance |
| 39: | insulating plate |
| 40: | exhaust pressure sensor |
| 41: | engine r.p.m. sensor |
| 42: | idling sensor |
| 43: | load sensor |
| 100: | particulate filter |

What is claimed is:

1. A filter which collects particulates in diesel exhaust gas, comprising:

a filter body disposed within a filter case which defines a plurality of filtering passages and transports the diesel exhaust gas from an upstream side of the filter body to a downstream side of the filter body; and a plurality of laminated fabric sheets each of which is comprised of randomly laminated fibers and respectively disposed along each of said filtering passages, wherein the fabric sheets increase in flow restriction as the diesel exhaust gas flows through the filtering passages from the upstream side of the filter body to the downstream side of the filter body.

2. The filter according to claim 1, further comprising a plurality of cylindrical filter bodies disposed in a coaxial relationship with each other such that the diesel exhaust gas flows from an inner cylindrical filter body to an outer cylindrical filter body.

3. The filter according to claim 1, wherein said fabric sheets are formed of ceramic fibers and fabric sheets disposed at the upstream side of the filter body include bold ceramic fibers, and fabric sheets disposed at the downstream side of the filter body include thin ceramic fibers.

4. The filter according to claim 1, wherein said fabric sheets are formed of ceramic fibers and fabric sheets disposed at the upstream side of the filter body are covered with a metallic wire net-like heater, and fabric sheets disposed at the downstream side of the filter body are covered with a porous tube.

5. The filter according to claim 1, further comprising a cylindrical filter body having an open end positioned at an upstream side of the filter body for receiving the diesel exhaust gas and a closed end positioned at a downstream side of the filter body, said cylindrical filter body varying in density with said downstream side being denser than said upstream side.

6. The filter according to claim 5, wherein an upstream portion of said cylindrical filter body includes bold ceramic fibers, and a downstream portion of said cylindrical filter body includes thin ceramic fibers.

7. The filter according to claim 5, wherein flow restriction of the filtering passages is gradually increased from said open end to said closed end of said cylindrical filter.

8. The filter according to claim 1, further comprising:

a plurality of cylindrical bodies disposed in a coaxial relationship with each other such that diesel exhaust gas flows from an inner cylindrical body to an outer cylindrical body;

a bypass pipe arranged in the innermost filter body; and an open-close type bypass valve disposed in one end of the bypass pipe for selectively transmitting the diesel exhaust gas.

9. The filter according to claim 8, said bypass pipe having a closed second end and further comprising a sub-filter with a metallic wire net-like heater which is energized when said sub-filter is clogged with particulates.

10. The filter according to claim 2, wherein flow restriction of the cylindrical bodies is changed from coarse to dense as diesel exhaust gas flows from the inner cylindrical body to the outer cylindrical body.

* * * * *

UNITED STATES PATENT AND TRADEMARK OFFICE

CERTIFICATE OF CORRECTION

PATENT NO. : 5,655,366

DATED : August 12, 1997

INVENTOR(S) : Hideo KAWAMURA

It is certified that error appears in the above-indentified patent and that said Letters Patent is hereby corrected as shown below:

Col. 1, line 44, change "10μm" to --30μm--
line 65, after "the" (first occurrence) insert --present--.

Col. 2, line 51, change "of filter" to --the filters--

Col. 3, line 59, change "19" to --18--

Col. 5, line 58, after "more" insert --configuration--

Col. 6, lines 25-55, delete in its entirety

Signed and Sealed this

Twenty-first Day of October 1997

*Attest:*

*Attesting Officer*

BRUCE LEHMAN

*Commissioner of Patents and Trademarks*